US005451167A

United States Patent [19]

Zielinski et al.

[11] Patent Number: 5,451,167

[45] Date of Patent: Sep. 19, 1995

[54] GROUNDING CLIP

[75] Inventors: James S. Zielinski, Schaumburg; John G. Drelicharz, Palatine, both of Ill.

[73] Assignee: Illinois Tool Works Inc., Glenview, Ill.

[21] Appl. No.: 281,517

[22] Filed: Jul. 28, 1994

[51] Int. Cl.[6] ..... H01R 13/648

[52] U.S. Cl. ..... 439/92; 439/435

[58] Field of Search ..... 439/92, 435–441, 439/444, 858, 861, 387

[56] References Cited

U.S. PATENT DOCUMENTS

| | | | |
|---|---|---|---|
| 3,528,050 | 9/1970 | Hindenburg | 439/92 |
| 3,627,900 | 12/1971 | Robinson | 439/387 |
| 4,029,384 | 6/1977 | Reinwall, Jr. | 439/397 |
| 4,087,149 | 5/1978 | Fischer | 439/435 |
| 4,384,753 | 5/1983 | Mixon, Jr. | 439/92 |
| 4,961,712 | 10/1990 | Schwenk et al. | 439/436 |

OTHER PUBLICATIONS

"Wire and Cable Holding Clip", by R. J. O'Connor, Western Electric Technical Digest, No. 64, Oct. 1981, p. 43.

*Primary Examiner*—Gary F. Paumen

*Attorney, Agent, or Firm*—Schwartz & Weinrieb

[57] ABSTRACT

An improved grounding clip connector for positively grounding an insulated conductor to an appliance panel comprises a base section, a first pair of laterally spaced blade members projecting upwardly from one edge portion of the base section, and a second pair of laterally spaced blade members projecting upwardly from a second opposite edge portion of the base section, the laterally spaced blade members defining vertical passageways between the pairs thereof for retaining the insulated conductor upon the connector. A spring clip member is integrally formed with the base section of the connector and is substantially C-shaped in configuration so as to cooperate with the base section of the connector in grasping the appliance panel therebetween. In accordance with the improvement of the present invention, the spring clip member is provided with a pair of axially spaced barbs or prong members for engaging the undersurface of the appliance panel, while the base section is provided with a third barb or prong member for engaging the upper surface of the appliance panel. The three barbs cooperate in concert so as to effectively define a pivot mechanism about which the connector can pivot upon the appliance panel. In this manner, should a force be inadvertently applied to the insulated conductor and thereby transmitted to the connector, the pivotal action or movement of the connector will cause the three barbs or prong members thereof to dig into the respective surfaces of the appliance panel with increased biting effects whereby the retention power or pull-off resistance of the connector with respect to the appliance panel is significantly enhanced.

20 Claims, 4 Drawing Sheets

GROUNDING CLIP

FIELD OF THE INVENTION

The present invention relates generally to electrical connectors for accommodating insulated conductors, and more particularly to an improved clip-type electrical connector which is adapted to penetrate the conductor insulation and thereby establish electrical contact with the conductor wire, and which is also adapted to be clipped onto a thin appliance panel by means of an improved spring clip member whereby positive grounding of the conductor wire to the appliance panel may be achieved, the improved spring clip member exhibiting increased holding power with respect to the appliance panel so as to prevent the inadvertent dislodgement of the grounding clip from the appliance panel under the action of a force tending to dislodge the grounding clip from the appliance panel.

BACKGROUND OF THE INVENTION

Grounding clips of the general aforenoted type are wellknown in the art as exemplified by means of the grounding clip illustrated and disclosed within U.S. Pat. No. 4,029,384 which issued to Ernest William Reinwall, Jr. on Jun. 14, 1977 and which is assigned to the assignee of the present patent application. As illustrated in the noted patent, and as can be appreciated from FIGS. 1 and 2 of the present patent application drawings, the prior art grounding clip is generally indicated by the reference character 10 and includes a base section 12, a first set of upstanding arms or blade members 14 and 16, and a second set of upstanding arms or blade members 18 and 20. The arms or blade members 14 and 16 are laterally spaced with respect to each other so as to define a vertical passageway 28 therebetween, and arms or blade members 18 and 20 are similarly spaced with respect to each other so as to likewise define another vertical passageway 28 therebetween. The arms or blade members 14–20 are provided with coined sections 32 defined upon upper surfaces thereof which are disposed opposite to or face each other whereby such sections 32 effectively define cutting surfaces for piercing peripheral portions of the insulation 34 disposed about the central conductor wire 36 of the insulated conductor 30. As the insulated conductor 30 is inserted between the oppositely disposed arms or blade members 14–20 and is particularly moved downwardly into the vertical passageways 28, the coined cutting edges 32 of the arms or blade members 14–20 penetrate the conductor insulation 34. The arms or blade members 16 and 20 are also provided with notched regions 38 within which peripheral portions of the conductor wire 36 are seated such that the peripheral portions of the conductor wire 36 are securely grasped or engaged by three circumferentially spaced sections of the arms or blade members 14–20.

As can be particularly appreciated from FIG. 2 of the present patent application drawings, the prior art grounding clip also has a spring clip member 24 integrally formed with the base section 12 by means of which the connector 10 can be secured at a fixed location upon an appliance panel 22, the base section 12 engaging the upper surface of the appliance panel 22 while the clip member 24 engages the undersurface of the panel 22. In particular, the clip member 24 is provided with a pair of spaced barbs or prongs 26 which engage the underside of the panel 22 so as to prevent unauthorized removal of the grounding clip or connector 10 from the panel 22 while readily facilitating or permitting the grounding clip connector 10 to be mounted upon the panel 22, that is, the grounding clip connector 10 can be easily mounted upon the panel 22 when the connector 10 is moved, relative to the panel 22, in the direction of arrow A, however, removal of the connector 10 from the panel 22 is effectively prevented when the connector 10 is attempted to be moved relative to the panel 22 in the direction of the arrow B, as seen in FIG. 2.

While the aforenoted grounding clip connector 10 has in fact been quite commercially successful and has exhibited the intended and expected mounting and removal operational characteristics noted hereinabove when the connector 10 has been utilized in connection with most appliance panels, it has been discovered that when such a connector 10 is utilized in connection with a relatively thin appliance panel, the holding or retention power, or resistance to removal, of the connector 10 with respect to the appliance panel, when the connector 10 is subjected to a force operating in the direction of arrow B, such as, for example, when an inadvertent force is impressed upon the insulated conductor 30, is not always sufficient to retain the connector 10 upon the appliance panel whereupon the connector 10 has unintentionally and undesirably become disengaged from the appliance panel.

Referring now to FIG. 3, a second type of known prior art grounding clip connector is illustrated and is generally indicated by the reference character 110. The grounding clip connector 110 is adapted to be mounted upon an edge portion of an appliance panel 122 in a manner similar to that of the grounding clip connector 10 of FIG. 2, however, in addition to the pair of laterally spaced barbs or prongs 126, only one of which is shown, provided upon a lower base section 127 of the connector 110 for engaging the under-surface of the appliance panel 122, a second pair of laterally spaced barbs or prongs 129, only one of which is shown, are integrally provided upon an upper section 131 of the connector 110 for engaging the upper surface of the appliance panel 122. A conductor wire 130 is secured to the connector 110 by means of a crimped section 133 of the connector 110 which is integrally formed with the upper and base sections 131 and 127 of the connector 110.

While the aforenoted grounding clip connector 110 has likewise been commercially successful, difficulties have also been encountered in connection with such a connector 110 when the connector 110 is mounted upon a relatively thin appliance panel, that is, premature or unintentional and undesirable disengagement of the connector 110 from the appliance panel have been encountered when a force, acting in the direction of arrow B, is, for example, impressed upon the conductor wire 133 due to an insufficient retention power or removal resistance of the grounding clip connector 110 with respect to the appliance panel.

A need therefore exists in the art, to which the present invention is directed, for a new and improved grounding clip connector which exhibits a sufficiently high retention force or removal resistance with respect to an appliance panel upon which the grounding clip connector is mounted such that the grounding clip connector will not be prematurely, unintentionally, and undesirably disengaged from the appliance panel when an external force is impressed upon the conductor wire operatively connected to the grounding clip connector, particularly in the instance that the particular appliance panel, upon which the grounding clip connector is mounted, is a relatively thin appliance panel.

OBJECTS OF THE INVENTION

Accordingly, it is an object of the present invention to provide a new and improved grounding clip connector.

Another object of the present invention is to provide a new and improved grounding clip connector which will be particularly useful in connection with an appliance panel whereby a conductor wire connected to the grounding clip connector can be grounded with respect to the appliance panel.

Still another object of the present invention is to provide a new and improved grounding clip connector which will be particularly useful in connections with a relatively thin appliance panel whereby enhanced retention power or pull-off resistance in connection with such a relatively thin appliance panel will be exhibited.

Yet another object of the present invention is to provide a new and improved grounding clip connector which will exhibit enhanced retention power or pull-off resistance in connection with a relatively thin appliance panel whereby premature, unintentional, and undesirable disengagement of the grounding clip connector from the appliance panel will effectively be prevented despite a force or moment transmitted to the connector by means of a force impressed upon the conductor wire operatively connected to the grounding clip connector.

Still yet another object of the present invention is to provide a new and improved grounding clip connector which will exhibit enhanced retention power or pull-off resistance with respect to a relatively thin appliance panel upon which the grounding clip connector is mounted as a result of a unique pivoting system effectively incorporated into the grounding clip connector when the connector is operatively mounted upon the appliance panel.

Yet still another object of the present invention is to provide a new and improved grounding clip connector which will exhibit enhanced retention power or pull-off resistance in connection with the relatively thin appliance panel upon which the grounding clip connector is mounted as a result of aforenoted pivoting system comprising barbs or prong members of the grounding clip connector engaging opposite surfaces of the appliance panel.

A further object of the present invention is to provide a new and improved grounding clip connector which will exhibit enhanced retention power or pull-off resistance in connection with the relatively thin appliance panel upon which the grounding clip connector is mounted as a result of the aforenoted barbs or prong members achieving enhanced engagement of the opposite surfaces of the thin appliance panel in response to pivotal movement of the grounding clip connector as a result of the aforenoted force or moment transmitted to the connector by means of the force impressed upon the conductor wire operatively connected to the grounding clip connector.

A still further object of the present invention is to provide a new and improved grounding clip connector which is easily and economically manufactured.

A yet further object of the present invention is to provide a new and improved grounding clip connector which is readily manufactured as a single piece component from a single blank of sheet metal stock.

SUMMARY OF THE INVENTION

The foregoing and other objectives pf the present invention are achieved in accordance with the present invention through the provision of a new and improved grounding clip connector which includes a base section, a first set of upstanding arms or blade members laterally spaced with respect to each other, and a second set of upstanding arms or blades laterally spaced with respect to each other and axially spaced from the first set of upstanding arms or blade members, the two sets of arms or blade members being adapted to fixedly mount an insulated conductor wire which is to be positively grounded with respect to an appliance panel. The connector is further provided with a spring clip member which is integrally formed with the base section and by means of which the connector is secured at a desired location upon the appliance panel.

In accordance with the particular improvement comprising the present invention, the spring clip member is provided with a pair of axially spaced barbs or prong members for engaging the undersurface of the appliance panel, and the base section is provided with a single barb or prong member which is located within an axially extending plane which is sufficiently close to the axially extending plane containing the pair of barbs or prong members of the spring clip member such that the three barbs or prong members together define a pivot axis about which the grounding clip connector can pivot relative to the appliance panel. This pivotal movement or action of the connector is caused, for example, when a force is inadvertently impressed upon the conductor wire mounted upon the connector such that a force, and resulting moment, is, in turn, impressed upon the connector. As a result of the pivotal movement or action of the connector, the three barbs or prong members increasingly bite or engage their respective surfaces of the appliance panel whereby the enhanced engagement, and therefore the retention power or pull-off resistance, of the grounding clip connector with respect to the appliance panel is exhibited or manifested.

BRIEF DESCRIPTION OF THE DRAWINGS

Various other objects, features, and attendant advantages of the present invention will become more fully appreciated from the following detailed description, when considered in connection with the accompanying drawings, in which like reference characters designate like or corresponding parts throughout the several views, and wherein.

DETAILED DESCRIPTION OF THE PREFERRED EMBODIMENT

Figure 2:
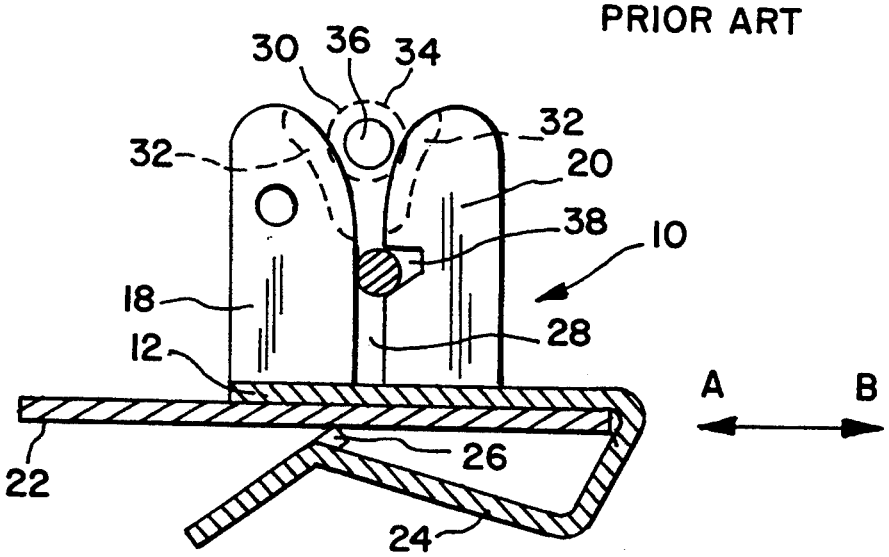
FIG. 2 PRIOR ART
FIG. 2 is a cross-sectional view of the prior art grounding clip connector shown in FIG. 1 taken along the line 2—2 of FIG. 1.

Referring now to the drawings, and more particularly to FIGS. 4–7 thereof, the new and improved grounding clip connector constructed in accordance with the principles of the present invention is generally indicated by the reference character 210. Similar to the known prior art grounding clip connector illustrated in FIGS. 1 and 2, the grounding clip connector 210 of the present invention is likewise seen to comprise a base section 212, a first pair of laterally spaced, upstanding arms or blade members 214 and 216 which are integral, at their lower end portions, with one side edge portion 213 of the base section 212, and a second pair of laterally spaced, upstanding arms or blade members 218 and 220 which are integral, at their lower end portions, with the opposite side edge portion 215 of the base section 212. The lateral spacing of the arms or blade members 214 and 216, as well as that of the arms or blade members 218 and 220, serve to define vertical passageways 228 therebetween for the reception of an insulated conductor 230. The upper, inner corner regions of the arms or blade members 214–220 are arcuately configured so as to facilitate or help guide the insertion of the insulated conductor 230 into the axially aligned passageways 228, and the arcuate corner portions 229 of the arms or blade members 214–220 are coined as at 232 so as to effectively reduce their axial thickness dimensions and thereby define cutting or knife edges upon the arms or blade members 214–220. As can best be appreciated from FIGS. 6 and 7, while arms or blade members 216 and 220 are disposed substantially perpendicular to the base section 212, arms or blade members 214 and 218 are disposed in a somewhat divergent manner with respect to arms or blade members 216 and 220 and also with respect to the base section 212. In this manner, as can be seen or appreciated from FIG. 7, the knife edge portions 232 of the arms or blade members 214 and 216, as well as the knife edge portions 232 of the arms or blade members 218 and 220, are axially spaced with respect to each other such that when the insulated conductor 230 is inserted between the arcuate portions 229 of the arms or blade members 214–220 and moved vertically downwardly within the vertical passageways 228, the knife edge portions 232 of the arms or blade members 214–220 engage and pierce axially separate peripheral portions of the conductor insulation 234 in order to eventually electrically contact the conductor wire 236. Still further, it is also seen that the arms or blade members 216 and 220 are provided with notched regions 238 such that when the insulated conductor 230 is inserted into the vertical passageways 228 and the knife edge portions 232 cut into and pierce the conductor insulation 234 so as to make contact with the conductor wire 236, the latter will tend to move into the notched regions 238 of the respective arms or blade members 216 and 220 such that the wire 236, and therefore the conductor 230, is effectively fixedly retained within the passageways 228 of the connector 210. In this manner, the conductor wire 236 is engaged by the arms or blade members 214 and 216, as well as by arms or blade members 218 and 220, at three circumferentially spaced locations, including two corner portions of each notched region 238, whereby inadvertent upward movement and removal or disengagement of the conductor 230 with respect to the arms or blade members 214–220 of the grounding clip connector 210 is effectively prevented.

Figure 4:
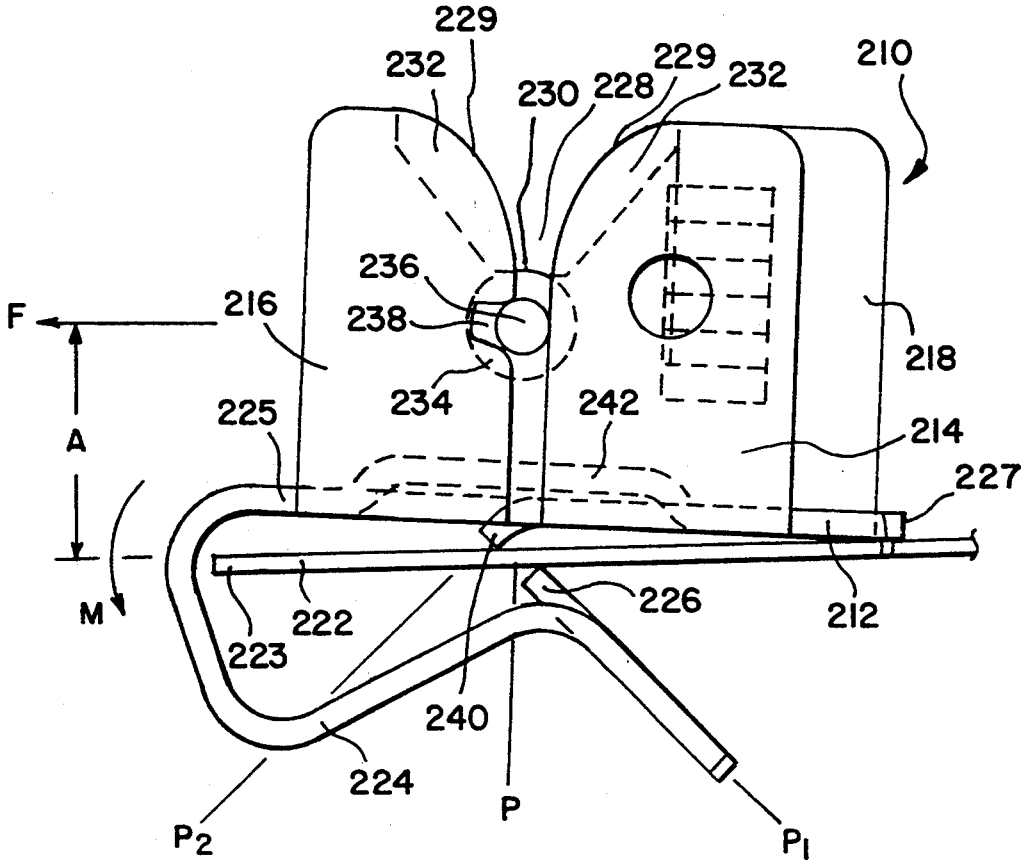
FIG. 4 is a right side elevational view of the new and improved grounding clip connector constructed in accordance with the principles of the present invention and shown as mounted upon a relatively thin appliance panel.

In order to mount the grounding clip connector 210 onto a support panel, which may be, for example, an appliance panel, 222 as shown in FIG. 4, the connector 210 is also provided with a spring clip member 224 which is integral with the base 212 along a side edge portion 225 which is interposed between the side edge portions 213 and 215. The spring clip member 224 is bent downwardly and toward the other or rear edge portion 227 of the base section 212 which is also interposed between the side edge portions 213 and 215 thereof. In this manner, it is seen that the spring clip member 224 has a substantially C-shaped configuration whereby the spring clip member 224 envelops a front edge portion 223 of the support or appliance panel 222 when the grounding clip connector 210 is mounted upon the appliance panel 222 in order to effectively positively ground the insulated conductor 230 with respect thereto.

Figure 1:
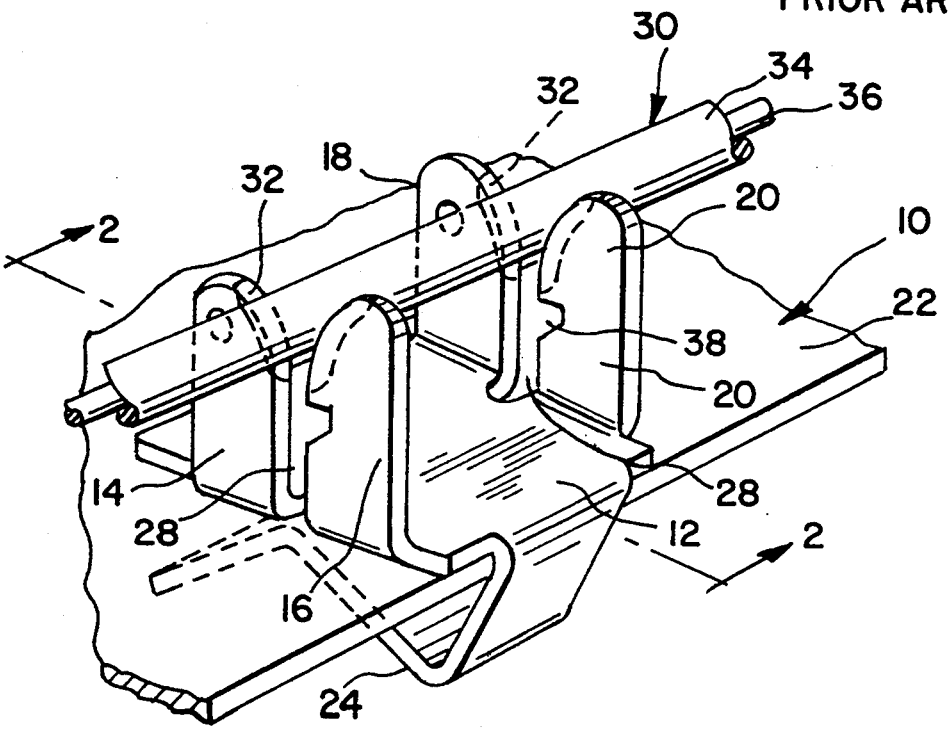
FIG. 1 PRIOR ART
FIG. 1 is a perspective view of a known, prior art grounding clip connector shown mounted upon an appliance panel.
Figure 3:
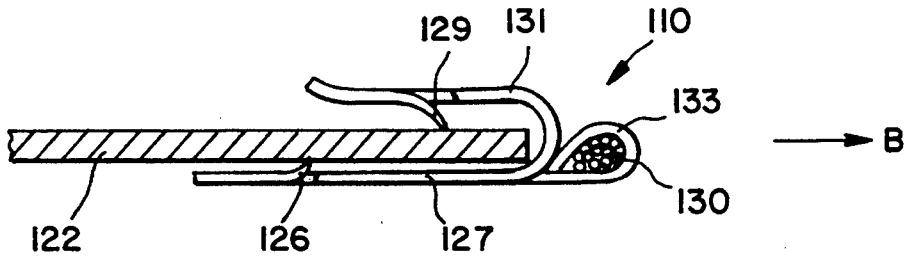
FIG. 3 PRIOR ART
FIG. 3 is a cross-sectional view similar to that of FIG. 2 showing, however, another known prior art grounding clip connector as mounted upon an appliance panel.

As has been noted hereinbefore, when a grounding clip connector such as that known in the prior art, and disclosed at 10 in FIGS. 1 and 2, is mounted upon the associated appliance panel 22, the retention power or pull-off resistance of the grounding clip connector 10 has proven insufficient to retain the grounding clip connector 10 upon the appliance panel 22. This is particularly the case when the appliance panel 22 is a substantially thin panel, such as, for example, an appliance panel having a thickness dimension within the range of 0.020–0.078 inches, and wherein further, a force, acting in the direction of arrow B of FIG. 2 in inadvertently impressed upon the insulated conductor 30. In view of such a directional force being impressed upon the conductor 30, the grounding clip connector 10 tends to be slidingly removed in the direction of arrow B despite the existence of the barbs or prongs 26 engaging the undersurface of the panel 22, the barbs or prongs 26 simply being scraped along the panel undersurface. A similar occurrence is likewise exhibited in connection with the prior art grounding clip connector 110 of FIG. 3.

In accordance with the principles of the present invention wherein the grounding clip connector 210 exhibits improved or enhanced retention power or pull-off resistance with respect to the appliance panel 222, the spring clip member 224 is provided with a pair of axially spaced barbs or prong members 226 for engaging the undersurface of the appliance panel 222 in a manner similar to the barbs 26 of the spring clip member 24 of the prior art grounding clip connector 10, however, in addition thereto, a third barb or prong member 240 is integrally formed, and struck from, the base section 212 of the grounding clip connector 210. The third barb or prong member 240 is seen to be axially interposed between the axially spaced barbs or prong members 226, as best appreciated from FIG. 6, and the third barb or prong member 240 is adapted to engage the upper surface of the appliance panel 222 as best seen in FIG. 4. In addition to the provision per se, however, of the third barb or prong member 240, the grounding clip connector 210 of the present invention exhibits several other unique features or structural characteristics which enables the connector 210 to in fact attain or achieve the aforenoted enhanced retention power or pull-off resistance with respect to the appliance panel 222. In addition to the third barb or prong member 240 being interposed between the pair of barbs or prong members 226 as considered in the axial direction taken along the longitudinal axis of the insulated conductor 230 as can be appreciated from FIG. 6, the barbs or prong members 226 and 240 are also disposed sufficiently close to each other in the lateral direction or sense so as to be disposed upon opposite sides of, but immediately adjacent to, a plane P as seen in FIG. 4. This close proximity to plane P effectively defines a pivot axis between the three barbs or prong members 240 and 226 acting in concert wherein the pivot axis is effectively located within the plane P. In practice, it has been found that if barb 226 or 240 is located, for example, a maximum distance of approximately 0.025 inches from plane P, the aforenoted pivotal action can be achieved. This pivotal action cannot be achieved, for example, with the grounding clip connector 110 shown in FIG. 3 due to the substantial lateral separation of the barbs or prong members 126 and 129.

Figure 5:
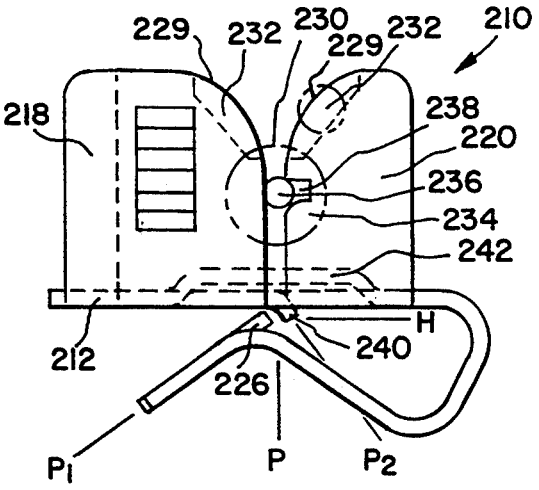
FIG. 5 is a left side elevational view of the new and improved grounding clip connector of the present invention as shown in FIG. 4 but not mounted upon the appliance panel.
Figure 6:
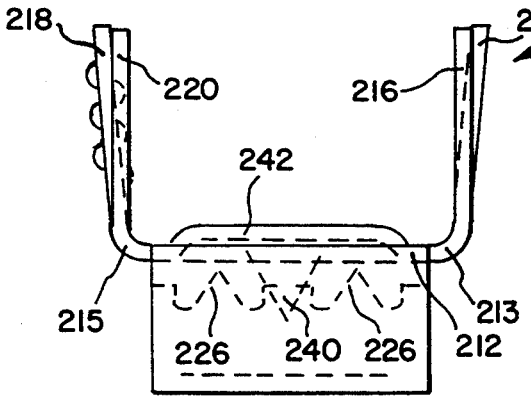
FIG. 6 is front elevational view of the new and improved grounding clip connector of the present invention as illustrated in FIGS. 4 and 5.
Figure 7:
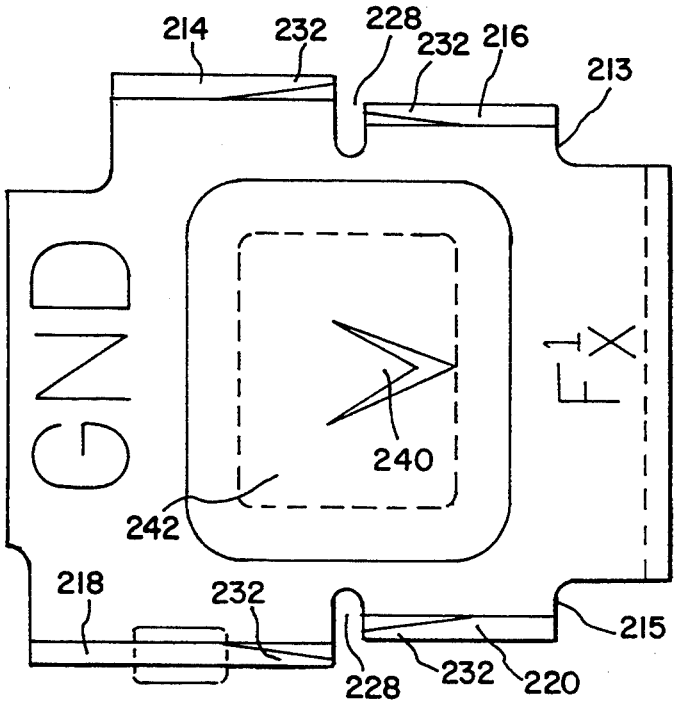
FIG. 7 is a top plan view of the new and improved grounding clip connector of the present invention as illustrated in FIGS. 4–6.

In addition to the aforenoted relative disposition of the barbs or prong members 226 and 240 of the grounding clip connector 210 of the present invention, it is further noted due to the particular positional interrelationship defined between the barbs or prong members 226 and 240 with respect to each other as well as to the plane P, that the base section 212 of the clip connector 210 is inclined with respect to the appliance panel 222, that is, with respect to the upper surface of the panel 222 with which the barb or prong member 240 is engaged. The rear edge portion 227 of the base section 212 is engaged with the appliance panel 222, however, the front edge portion 225 of the base section 212 of the connector 210 is elevated with respect to the appliance panel 222. This elevation or clearance defined between the front edge portion 225 of the base section 212 of the connector 210 also serves to facilitate the pivotal action or movement of the connector 210 about the pivot point or axis located within plane P as denoted by means of the arcuate arrow M as seen in FIG. 4. If the base section 212 was in fact in surface contact with the appliance panel 222 throughout its extent between, for example, the rear and front edge portions 227 and 225 thereof, as is the case of the base section 12 of the connector 10 with respect to the appliance panel 22, as seen in FIG. 1, no pivotal action could be achieved. The inclination of the base section 212 of the connector 210 with respect to the appliance panel 222, and the consequent elevation of the front edge portion 225 of the base section 212 of the connector 210, is achieved in accordance with another unique feature of the present invention. As best seen in FIG. 5, the lengths or vertical extents or depths of the barbs or prong members 226 and 240, as taken along the vertical plane P, are such that the barbs or prong members 226 and 240 effectively overlap each other in the vertical direction, or in other words, the barbs 226 are disposed above a horizontal plane H when the connector 210 is disposed in an unstressed state free from the appliance panel 222, while the barb 240 is disposed beneath the horizontal plane H. Consequently, when the connector 210 is mounted upon the appliance panel 222, the spring clip member 224 must be effectively expanded or opened in order to accommodate the appliance panel 222, the barbs 226 then being disposed beneath the horizontal plane, which is now effectively defined by means of the appliance panel 222 as seen in FIG. 4, while the barb 240 is disposed above the horizontal plane of appliance panel 222.

The significance of the aforenoted pivotal action or movement of the connector 210 with respect to the appliance panel 222, and particularly the pivotal action or movement of the barbs or prong members 226 and 240 of the connector 210 with respect to the appliance panel 222, is that as the connector 210 pivots in the arcuate sense or direction indicated by the arrow M in FIG. 4, the barbs or prong members 226 and 240 similarly pivot with respect to the appliance panel 222 whereby the teeth or pointed portions of the barbs or prong members 226 and 240 exhibit an enhanced biting engagement with respect to the respective surfaces of the appliance panel 222 with which the barbs or prong members 226 and 240 are engaged. Consequently, the retention power or pull-off resistance of the connector 210 with respect to the appliance panel is increased. As schematically shown in FIG. 4, the pivotal action or movement of the connector 210 with respect to the appliance panel 222 may be caused, for example, by means of a force F which is inadvertently impressed upon the insulated conductor 230. In view of the distance or moment arm A defined between the vertical disposition of the conductor 230 with respect to the upper surface of the appliance panel 222 with which the barb or prong member 240 is engaged, a moment M is created which causes the pivotal action or movement of the connector 210 with respect to the appliance panel 222.

Figure 8:
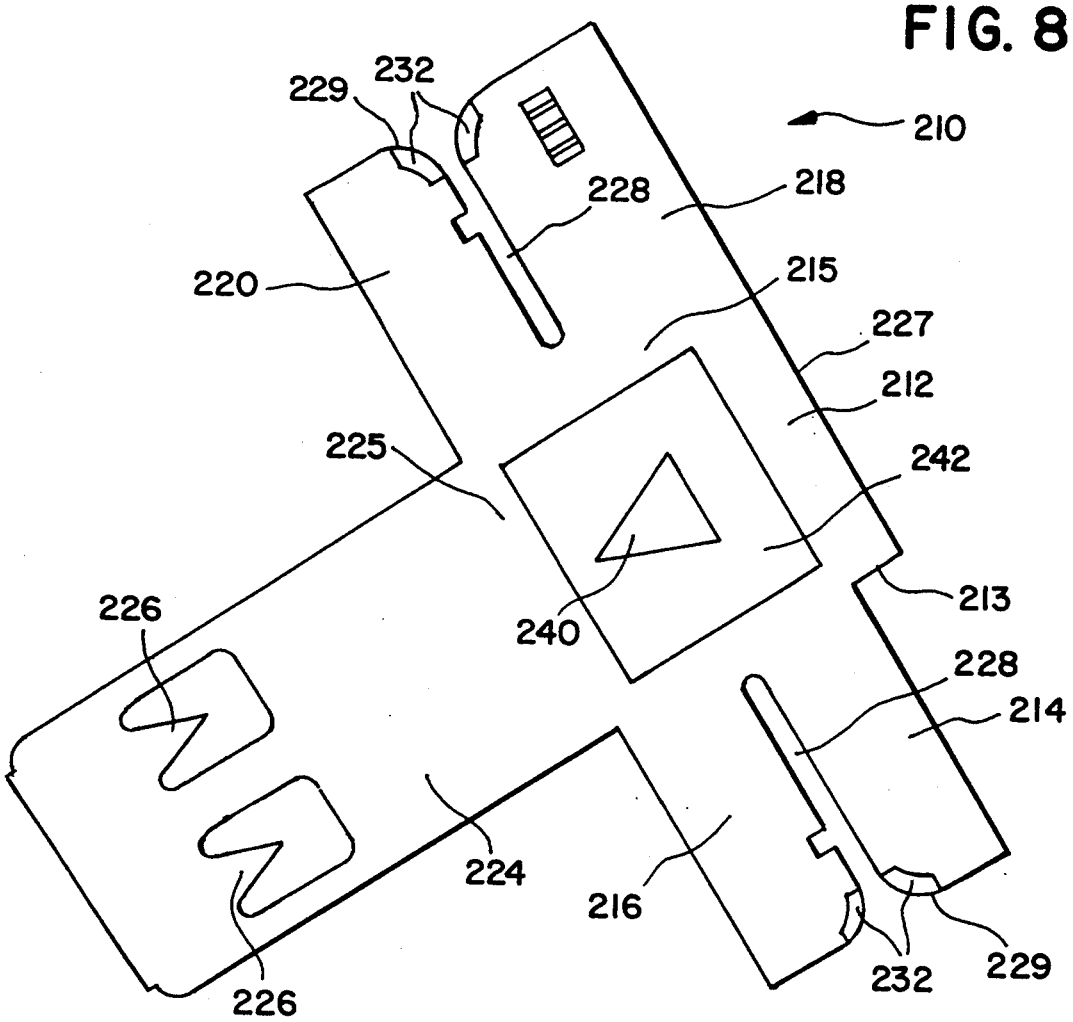
FIG. 8 is a top plan view of the new and improved grounding clip connector of the present invention as punched from a single piece of sheet metal stock and prior to the bending of the various component portions of the grounding clip connector so as to form the finished grounding clip connector from the punched sheet metal stock blank illustrated.

With reference still being made to FIG. 4, it is further noted that the barbs or prong members 226 and 240 are preferably disposed at predetermined angles or orientations with respect to each other as well as with respect to the base section 212, as is also seen in FIG. 5, and it is particularly noted that the barbs or prong members 226 and 240 are oriented along planes $P_1$ and $P_2$, respectively, which are substantially perpendicular to each other. In addition, the planar orientation of the barbs or prong members 226 with respect to the base section 212 of the connector 210 is approximately 35°, while the planar orientation of the barb or prong member 240 with respect to the base section 212 of the connector 210 is approximately 55°. It is further noted that in order to provide the barbs or prong members 226 and 240 with such relative angular orientations, as well as to provide the barb or prong member 240 with its particular length dimension such that the barbs or prong members 226 and 240 may overlap each other in the vertical direction as noted hereinbefore, the barb or prong member 240 is angularly dependent and struck from a vertically recessed pad portion 242 of the base section 212. As is also seen from FIG. 8, the entire connector 210 may be formed as a one-piece punched blank from a suitable sheet metal stock whereupon the particular components, portions, or members of the connector may be appropriately bent or formed such that the final connector 210 may have the useful form or configuration as shown in FIGS. 4–7.

TEST RESULTS

In order to further demonstrate the enhanced or improved retention power or pull-off resistance of the grounding clip connector of the present invention with respect to the retention power or pull-off resistance of the known prior art grounding clip connector shown in FIGS. 1 and 2, pull-off resistance testing was conducted in accordance with Underwriters Laboratories (U.L.) Specification E54730 for the grounding clip connector 210 of the present invention and the grounding clip connector 10 of the noted prior art of FIGS. 1 and 2. The following results were obtained:

EXAMPLE 1

In accordance with a first set of test results, an appliance panel having a thickness dimension of 0.020 inches was used, and five (5) samples of each one of the prior art and present invention connectors were tested. The test results were as follows, it being stated that in connection with the pull-off resistance force noted as being measured in connection with the connector 210 of the present invention, the measured force value never exceeds twelve (12) pounds and is listed with a plus (+) sign next to the value because such was the measured force value limit of the scale apparatus being employed during the testing procedures. Consequently, the pull-off resistance truly characteristic of the tested sample could be well in excess of the recorded force value:

| SAMPLE NUMBER | PULL-OFF FORCE (LB) PRIOR ART CONNECTOR | PRESENT INVENTION CONNECTOR |
|---|---|---|
| 1 | 6.0 | 10.2 |
| 2 | 3.1 | 12.0+ |
| 3 | 3.7 | 12.0+ |
| 4 | 2.9 | 10.9 |
| 5 | 3.9 | 12.0+ |

EXAMPLE 2

In accordance with a second set of test results, an appliance panel having a thickness dimension of 0.019 inches was used, and five (5) samples of each one of the prior art and present invention connectors were tested. The test results were as follows, the same statement noted in connection with the measured force value limit of the scale apparatus in Example 1 again being applicable to the test results in Example 2:

| SAMPLE NUMBER | PULL-OFF FORCE (LB) PRIOR ART CONNECTOR | PRESENT INVENTION CONNECTOR |
|---|---|---|
| 1 | 2.9 | 12.0+ |
| 2 | 3.9 | 12.0+ |
| 3 | 3.4 | 12.0+ |
| 4 | 4.2 | 12.0+ |
| 5 | 4.4 | 11.6 |

EXAMPLE 3

In accordance with a third set of test results, an appliance panel having a thickness dimension of 0.015 inches was used, and five (5) samples of each one of the prior art and present invention connectors were tested. The test results were as follows, it again being noted, as in the case of the test results of the above-listed Examples 1 and 2, that the measured force value limit of the scale apparatus is maximized at twelve (12) pounds:

| SAMPLE NUMBER | PULL-OFF FORCE (LB) PRIOR ART CONNECTOR | PRESENT INVENTION CONNECTOR |
|---|---|---|
| 1 | 3.8 | 11.7 |
| 2 | 3.5 | 12.0+ |
| 3 | 5.1 | 12.0+ |
| 4 | 3.7 | 12.0+ |
| 5 | 4.3 | 11.3 |

It is thus seen from the above-noted test results that the pull-off force, resistance force, or retention power of the grounding clip connector 210 of the present invention is substantially greater than the pull-off force, resistance force, or retention power of the conventional, prior art grounding clip connector 10. In particular, it is noted that the grounding clip connector 210 of the present invention consistently exhibits a pull-off resistance or retention power which is at least approximately three or four times the pull-off resistance or retention power of the conventional prior art grounding clip connector 10. These results are due to the various structural features of the present invention which enable or facilitate the pivotal movement or action of the grounding clip connector 210 of the present invention to be achieved. In particular, the grounding clip connector 210 of the present invention is provided with the third barb or prong member 240 which acts in concert with the pair of barbs or prong members 226 so as to define a pivot axis which is effectively located within or along the vertical plane P. The barbs or prong members 226 and 240 also overlap each other in the vertical direction so as to provide the connector 210 with an inclined elevation of the base section 212 thereof with respect to the appliance panel 222 when the connector 210 is mounted upon the appliance panel 222, and the pivotal action or movement of the connector 210 with respect to the appliance panel 222 permits the three barbs or prong members 226 and 240 to increasingly bite or dig into the respective surfaces of the appliance panel 222 as the connector 210 undergoes its pivotal movement or action. It is therefore seen that the new and improved grounding clip connector 210 of the present invention does in fact achieve its intended objectives, and such achieved objectives have in fact been demonstrated or manifested by means of the noted test results.

In light of the foregoing teachings, it is submitted that many modifications and variations of the present invention are possible without departing from the import of the invention. For example, while a single third barb or prong member 240 has been illustrated, a pair of barbs or prong members 240 would also be able to be employed in connection with the pair of barbs or prong members 226 provided that the relative disposition of the barbs or prong members 226 and 240 with respect to the plane P was maintained, as well as, for example, the depth dimension of the barbs or prongs 240 with respect to the barbs or prong members 226 such that the barbs or prong members 226 and 240 overlap each other in the vertical direction whereby the pre-disposed inclined elevation of the base section 212 of the connector 210 with respect to the appliance panel 222 would nevertheless still be achieved and the pivotal action or movement of the connector 210 with respect to the appliance panel 222 would be facilitated and permitted. Consequently, it is therefore to be understood that within the scope of the appended claims, the present invention may be practiced otherwise than as specifically described herein.

What is claimed as new and desired to be protected by Letters Patent of the United States of America, is:

1. An improved grounding clip connector for positively grounding an insulated conductor to a support panel, comprising:

a base section;

a first pair of spaced blade members, defining a first passageway therebetween and connected to said base section, for mounting a first portion of said conductor within said first passageway;

a second pair of spaced blade members, defining a second passageway therebetween and connected to said base section, for mounting a second portion of said conductor within said second passageway;

a spring clip member connected to said base section for cooperating with said base section in grasping opposite surfaces of said support panel when said connector is mounted upon said support panel;

first barb means defined upon said spring clip member for pointedly engaging a first one of said opposite surfaces of said support panel when said connector is mounted upon said support panel; and second barb means defined upon said base section for pointedly engaging a second one of said opposite surfaces of said support panel when said connector is mounted upon said support panel;

said first and second barb means being disposed sufficiently close together so as to act together in concert to define pivot means for permitting said connector to pivot with respect to said support panel when an external force is impressed upon said connector whereby said first and second barb means, pivotable with said connector, exhibit enhanced pointed engagement with said surfaces of said support panel so as to increase the retention power and pull-off resistance of said connector with respect to said support panel.

2. The connector as set forth in claim 1, wherein:

said first pair of blade members are axially spaced from said second pair of blade members so as to mount axially spaced first and second portions of said conductor.

3. The connector as set forth in claim 2, wherein:

said first barb means comprises a pair of axially spaced barb members; and said second barb means comprises a single barb member axially interposed between said pair of axially spaced barb members.

4. The connector as set forth in claim 1, wherein:

said first and second barb means have predetermined length dimensions such that said first and second barb means overlap each other in a vertical direction perpendicular to said base section of said connector whereby said first barb means of said spring clip member is disposed above a horizontal plane disposed parallel to said base section of said connector when said connector is disposed in a non-stressed state free of said support panel, and said second barb means of said base section is disposed beneath said horizontal plane disposed parallel to said base section of said connector when said connector is disposed in said non-stressed state free of said support panel.

5. The connector as set forth in claim 4, wherein:

said first barb means of said spring clip member is disposed beneath said horizontal plane, and said second barb means of said base section is disposed above said horizontal plane when said connector is mounted upon said support panel whereby said base section of said connector is inclined with respect to said horizontal plane and said support panel such that a front edge portion of said base section of said connector is elevated with respect to a front edge portion of said support panel so as to permit said connector to undergo pivotal movement with respect to said support panel.

6. The connector as set forth in claim 1, wherein:

said first and second barb means of said spring clip member and said base section of said connector are disposed upon opposite sides of, but immediately adjacent to, a vertical plane disposed perpendicular to said base section of said connector so as to define, in concert, said pivot means for permitting said connector to pivot with respect to said support panel.

7. The connector as set forth in claim 4, wherein:

said first and second barb means are disposed at predetermined angles with respect to said base section of said connector.

8. The connector as set forth in claim 7, wherein:

said first barb means is disposed at an angle of approximately 35° with respect to said base section of said connector; and said second barb means is disposed at an angle of approximately 55° with respect to said base section of said connector.

9. The connector as set forth in claim 7, further comprising:

vertically recessed pad means defined within said base section of said connector and from which said second barb means extends for providing said second barb means with said predetermined length dimension and for permitting said second barb means to be disposed at said predetermined angle.

10. The connector as set forth in claim 1, wherein:

said spring clip member has a substantially C-shaped configuration for enveloping a front edge portion of said support panel.

11. In combination, an improved grounding clip connector for positively grounding an insulated conductor to a support panel, comprising:

a support panel;

a base section of said grounding clip connector;

a first pair of spaced blade members, defining a first passageway therebetween and connected to said base section of said grounding clip connector, for mounting a first portion of said conductor within said first passageway;

a second pair of spaced blade members, defining a second passageway therebetween and connected to said base section of said grounding clip connector, for mounting a second portion of said conductor within said second passageway;

a spring clip member connected to said base section of said grounding clip connector for cooperating with said base section of said grounding clip connector in grasping opposite surfaces of said support panel when said grounding clip connector is mounted upon said support panel;

first barb means defined upon said spring clip member of said grounding clip connector for pointedly engaging a first one of said opposite surfaces of said support panel when said grounding clip connector is mounted upon said support panel; and second barb means defined upon said base section of said grounding clip connector for pointedly engaging a second one of said opposite surfaces of said support panel when said grounding clip connector is mounted upon said support panel;

said first and second barb means being disposed sufficiently close together so as to act together in concert to define pivot means for permitting said grounding clip connector to pivot with respect to said support panel when an external force is impressed upon said grounding clip connector whereby said first and second barb means, pivotable with said grounding clip connector, exhibit enhanced pointed engagement with said surfaces of said support panel so as to increase the retention power and pull-off resistance of said grounding clip connector with respect to said support panel.

12. The combination as set forth in claim 11, wherein:

said first pair of blade members are axially spaced from said second pair of blade members so as to mount axially spaced first and second portions of said insulated conductor.

13. The combination as set forth in claim 12, wherein:

said first barb means comprises a pair of axially spaced barb members; and said second barb means comprises a single barb member axially interposed between said pair of axially spaced barb members.

14. The combination as set forth in claim 11, wherein:

said first and second barb means have predetermined length dimensions such that said first and second barb means overlap each other in a vertical direction perpendicular to said base section of said grounding clip connector whereby said first barb means of said spring clip member is disposed above a horizontal plane disposed parallel to said base section of said grounding clip connector when said grounding clip connector is disposed in a nonstressed state free of said support panel, and said second barb means of said base section of said grounding clip connector is disposed beneath said horizontal plane disposed parallel to said base section of said grounding clip connector when said grounding clip connector is disposed in said nonstressed state free of said support panel.

15. The combination as set forth in claim 14, wherein:

said first barb means of said spring clip member of said grounding clip connector is disposed beneath said horizontal plane, and said second barb means of said base section of said grounding clip connector is disposed above said horizontal plane, when said grounding clip connector is mounted upon said support panel whereby said base section of said grounding clip connector is inclined with respect to said horizontal plane and said support panel such that a front edge portion of said base section of said grounding clip connector is elevated with respect to a front edge portion of said support panel so as to permit said grounding clip connector to undergo pivotal movement with respect to said support panel.

16. The combination as set forth in claim 11, wherein:

said first and second barb means of said spring clip member and said base section of said grounding clip connector are disposed upon opposite sides of, but immediately adjacent to, a vertical plane disposed perpendicular to said base section of said grounding clip connector so as to define, in concert, said pivot means for permitting said grounding clip connector to pivot with respect to said support panel.

17. The combination as set forth in claim 14, wherein:

said first and second barb means are disposed at predetermined angles with respect to said base section of said grounding clip connector.

18. The combination as set forth in claim 17, wherein:

said first barb means of said spring clip member of said grounding clip connector is disposed at an angle of approximately 35° with respect to said base section of said grounding clip connector; and said second barb means of said base section of said grounding clip connector is disposed at an angle of approximately 55° with respect to said base section of said grounding clip connector.

19. The combination as set forth in claim 17, further comprising:

vertically recessed pad means defined within said base section of said grounding clip connector and from which said second barb means of said base section of said grounding clip connector extends for providing said second barb means with said predetermined length dimension and for permitting said second barb means to be disposed at said predetermined angle.

20. The combination as set forth in claim 11, wherein:

said spring clip member of said grounding clip connector has a substantially C-shaped configuration for enveloping a front edge portion of said support panel.

* * * * *